United States Patent [19]

Forman

[11] 4,052,130

[45] Oct. 4, 1977

[54] WAX APPLICATION DEVICE

[76] Inventor: Bruce Jan Forman, 1101 Palms Blvd., Venice, Calif. 90291

[21] Appl. No.: 636,694

[22] Filed: Dec. 1, 1975

[51] Int. Cl.[2] ..... A46B 11/08; A47L 13/02; B43M 1/02

[52] U.S. Cl. ..... 401/2; 401/35; 427/277

[58] Field of Search ..... 401/1-3, 401/35, 198; 722/416

[56] References Cited

U.S. PATENT DOCUMENTS

| | | | |
|---|---|---|---|
| 1,328,769 | 1/1920 | Spencer | 401/1 |
| 1,592,148 | 7/1926 | Munn | 401/1 |
| 1,754,330 | 4/1930 | Litony | 401/1 X |
| 2,032,983 | 3/1936 | Hackney | 401/35 X |
| 2,235,519 | 3/1941 | Hausknecht | 401/2 |
| 3,702,917 | 11/1972 | Christensen | 401/2 X |
| 3,711,211 | 1/1973 | Garrison | 401/2 |

FOREIGN PATENT DOCUMENTS

| | | | |
|---|---|---|---|
| 811,133 | 1/1937 | France | 222/416 |
| 566,184 | 11/1923 | France | 401/1 |

*Primary Examiner*—Stephen C. Pellegrino
*Attorney, Agent, or Firm*—Robert J. Schaap

[57] ABSTRACT

An article for depositing a hot wax substance on a substrate in a desired pattern and which article includes a bowl having a reservoir for retaining the hot wax substance in a relatively liquid state. A spout extends outwardly from the housing and has a capillary tube connected to the spout and extending into the reservoir and terminating near the bottom wall of the reservoir. Moreover, this capillary tube has a relatively small diameter so that when the wax is in a heated state it will tend to rise in the tube by capillary action. When the reservoir is tipped so that the spout is pointed downwardly, the wax will flow through the spout and onto the substrate from the reservoir by means of a siphoning action. In a preferred aspect of the invention, a retaining tube extends through the reservoir in heat conductive relationship with the capillary tube. This retaining tube is designed to receive a heater element. In this way, the heater element actually applies heat to the wax in the reservoir retaining the same in the liquid state and also applies the heat to the capillary tube through heat conductivity. Several additional embodiments of the article are also disclosed and include a spatula in place of the spout and means for withdrawing the wax substance from a substrate after it has been applied. Moreover, the present invention provides a method of depositing and removing a hot wax substance from a substrate.

27 Claims, 16 Drawing Figures

WAX APPLICATION DEVICE

BACKGROUND OF THE INVENTION

This invention relates in general to certain new and useful improvements in wax deposition devices and, more particularly, to devices of the type stated which are capable of applying a hot wax substance to a substrate in a fairly precisely controlled manner.

In recent years, the art of tjanting and batiking has received increased prominence. In general, these arts relate to the technique for depositing a hot wax substance, such as a paraffin wax, for example, to a substrate, such as cloth, in a desired pattern, and thereafter processing the cloth to render the pattern permanent in the fabric. While the art of tjanting and batiking is actually several centuries old, the particular usefulness of applying hot wax to a substrate has received increased attention, not only as a craft and a hobby, but also due to several commercial applications.

Thus, it has been found that wax deposition onto a substrate can be highly effective, not only in the art of tjanting and batiking, but in the art of ceramics where it is desired to apply wax resist to a piece of pottery and immerce the pottery in an environment where glaze is applied. The wax resist will prevent the glaze from adhering in the area of the resist and when the glaze is fired, it solidifies and thereby generating the design created by the wax deposition. Moreover, wax deposition has been found to be highly effective in lost wax casting so that it can be highly effective for use by jewelers and dental technicians and others concerned with casting of metal articles.

There are several commercially available devices for applying hot wax to a substrate and these devices are typically referred to in the art as "wax pens." The most rudimentary form of these wax pens includes a housing having a reservoir to contain the hot wax with a spout on the housing and which communicates with the reservoir. A handle is connected to the housing for manipulation of the device. Thus, when the user wishes to apply the hot wax to a substrate, the housing is merely tipped so that the wax can pass through the spout to the substrate. One of the primary problems with this type of device is that the wax flow does not necessarily cease upon tipping the housing to an upright position and, hence, some overflow results. In addition, the wax in the housing, which must be maintained at a temperature of at least about 250° F or hotter, will tend to cool rather quickly, thereby necessitating or requiring the user of the device to place the housing over a heat source to reheat the wax.

In order to obviate the problem of maintaining the wax in a hot condition, there have been several devices which provide for heater elements disposed in relationship to the housing in order to maintain the wax at at least a minimum temperature. Moreover, in order to control the flow problems, there have been several devices which utilize some form of a valve, which is typically operated by a manually operable switch mechanism. The major problem with these valves is that the valves are relatively inexpensive in order to keep the retail cost of the wax pen to a minimum. Hence, these valves have a history of malfunctioning. One of the most serious problems with these valves is that the valve itself must be heated in order to prevent the wax from solidifying in the valve. Nevertheless, this very application of heat tends to create malfunctions in the valve. In fact, when the user of the device turns the heater off for any period of time, the wax in the reservoir and valve will solidify. Upon reheating, the formed particles which may be entrained in the wax tend to accumulate in the valve thereby clogging the valve and impairing the usefulness of the device, if not totally rendering the device useless.

Notwithstanding any of the above, the use of the valve in connection with the reservoir containing the hot wax has not resolved the problem of over deposition. Typically, the user of the device must apply the wax in a controlled pattern, and one or two additional drops of wax which are undesired can virtually destroy the pattern. Consequently, the various valve controlled devices have not eliminated the major problem existing with wax pens. Moreover, the very provision of a valve-type control device has substantially increased the cost of such wax pens, thereby diminishing the available market and militating against their use.

The present invention obviates these and other problems in the provision of a relatively simple and inexpensive wax application device which includes a housing having a reservoir for containing the hot wax. A spout extends from the housing and extends into the reservoir. A capillary tube is connected to the inner end of the spount and extends downwardly and terminates near the bottom wall of the reservoir. Moreover, the capillary tube is designed with a relatively small diameter bore so that the wax will rise in the capillary tube, much in the same manner that mercury rises in a tube by capillary action. When the housing is tipped, wax will immediately extend into and through the spout so that it may be deposited upon the substrate. Moreover, when the housing is uprighted to its level position, that is the position where the spout is removed from the substrate, wax flow will automatically cease since the siphon action which is created by tipping of the spout will also terminate.

The presnt invention also overcomes these various problems mentioned in the prior art with the provision of a retaining tube which is designed to receive a conventional heating element. Moreover, the capillary tube is located in position with respect to the receiving tube in order to heat and maintain the wax in the capillary tube at a certain temperature by means of heat conductivity. In addition, the present invention is uniquely designed to provide a spatula and removable spouts, as well as a mechanism for removing the wax from the substrate after it has been applied thereto.

OBJECTS OF THE INVENTION

It is, therefore, the primary object of the invention to provide a wax application device which is designed to apply wax from a reservoir to a substrate upon tipping of the reservoir so that wax can be deposited through a spout on the reservoir and which immediately ceases all flow of wax upon returning the reservoir to its initial upright position.

It is another object of the present invention to provide a device of the type stated, which at least in one embodiment includes a provision for maintaining the wax at a relatively high temperature.

It is a further object of the present invention to provide a device of the type stated which can be constructed at a relatively low cost and does not require the use of expensive valve devices to control the wax flow.

It is also an object of the present invention to provide a device of the type stated which requires essentially no moving parts and which is highly reliable in its operation and relatively rigid in its construction.

it is another object of the present invention to provide a device of the type stated which includes a provision for withdrawing of hot wax from a substrate after it has been applied thereto.

It is another salient object of the present invention to provide a method of controllably applying wax substances to a substrate from a reservoir by mere manual positioning of the reservoir.

With the above and other objects in view, my invention resides in the normal features of form, construction, arrangement and combination of parts presently described and pointed out in the claims.

BRIEF DESCRIPTION OF THE DRAWINGS

Figures 1, 2, 3, 4, 5, 6, 7, 8, 9:
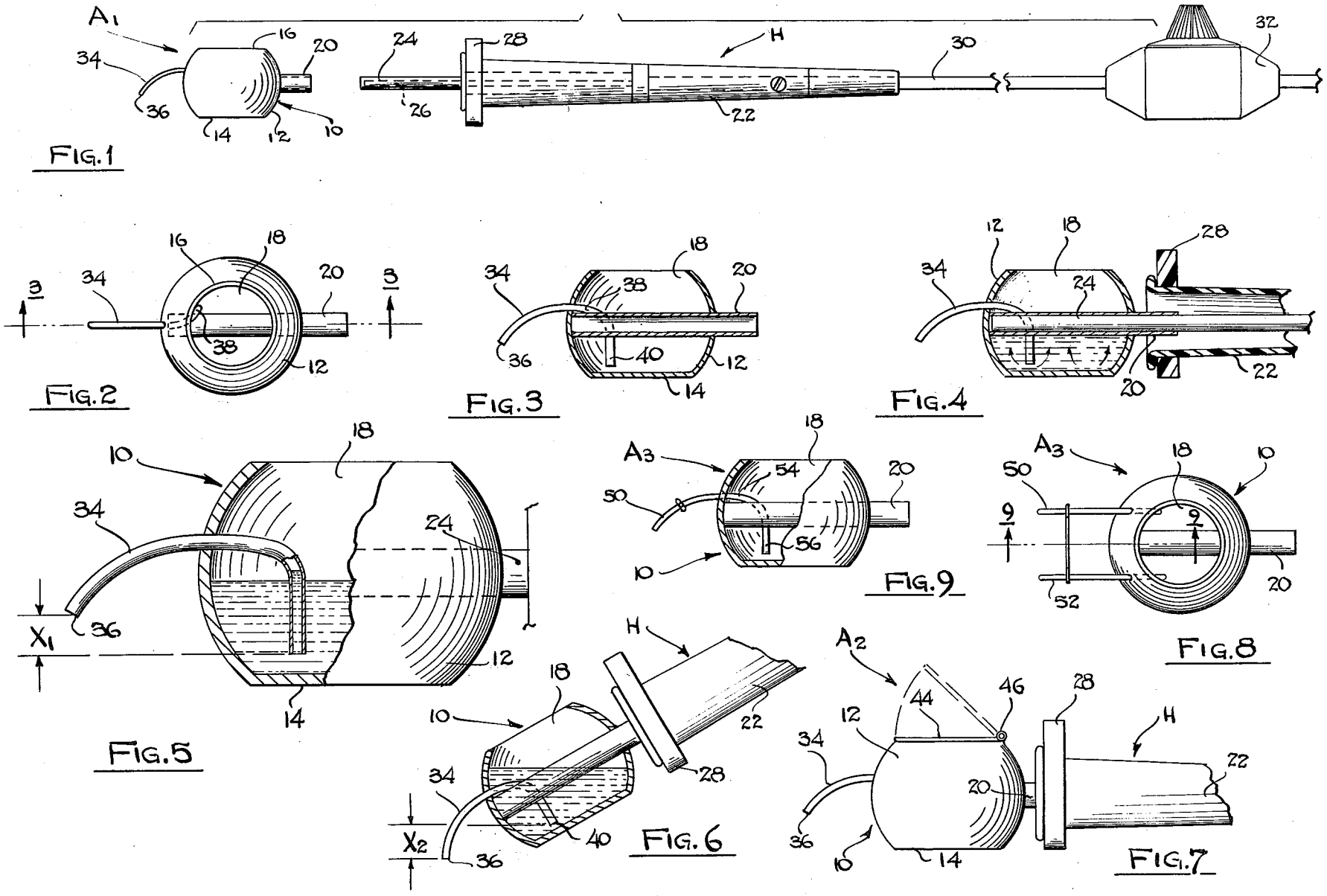
Figure 10:
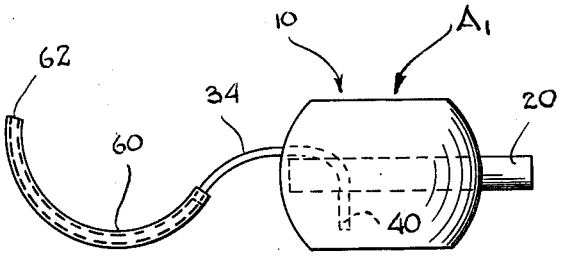
Figure 11:
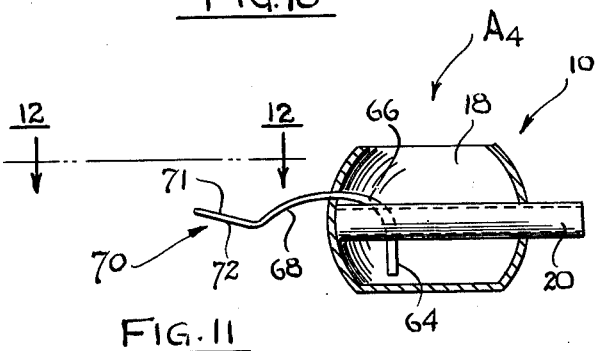
Figure 12:
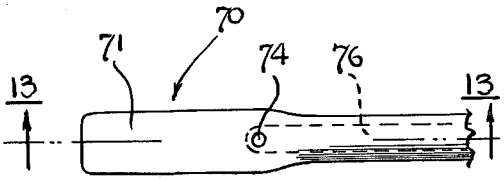
Figure 13:
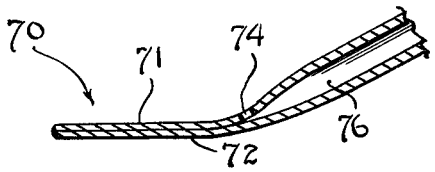
Figure 14:
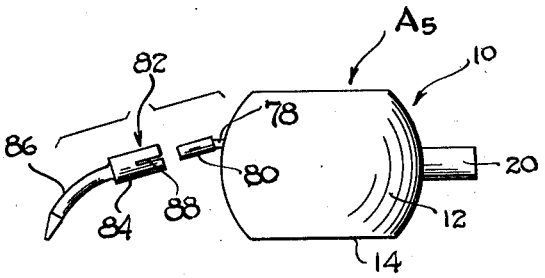
Figure 16:
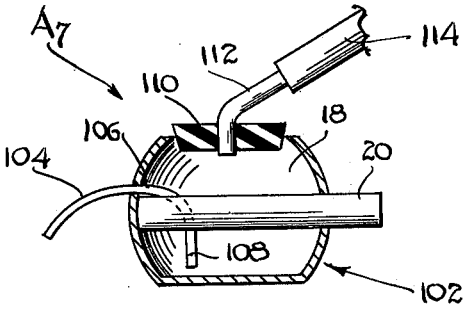
Figure 15:
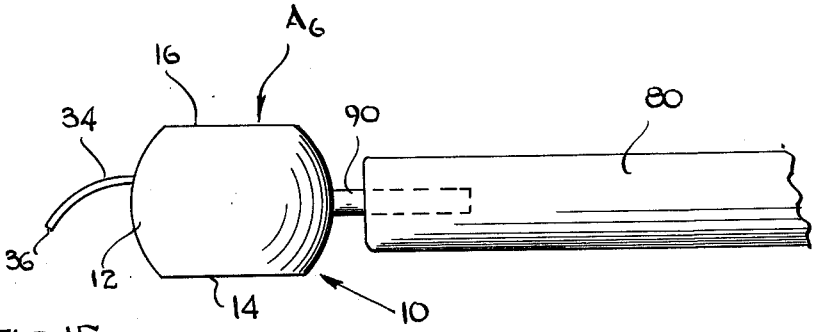

Having thus described the invention in general terms, reference will now be made to the accompanying drawings in which:

FIG. 1 is an exploded side elevational view of a wax application device constructed in accordance with and embodying the present invention, and showing its relationship to a conventional handle containing heating mechanism along with a temperature control means therefor;

FIG. 2 is a top plan view of the wax application device of FIG. 1;

FIG. 3 is a vertical sectional view taken along line 3—3 of FIG. 2;

FIG. 4 is a vertical sectional view, similar to FIG. 3, and illustrating a heater rod forming part of the handle illustrated in FIG. 1 inserted into a retaining tube in the wax application device;

FIG. 5 is a fragmentary vertical sectional view of the device of FIG. 1 and showing the capillary rise of the hot wax substance in a capillary tube forming part of the device, by means of capillary action;

FIG. 6 is a fragmentary sectional view, somewhat similar to FIG. 5, and showing the deposition of the hot wax substance through a siphoning action when the reservoir containing the hot wax substance has been tipped somewhat;

FIG. 7 is a side elevational view, similar to FIG. 1, and showing an embodiment of the device with a pivotal lid thereon;

FIG. 8 is a top plan view of a modified form of wax application device showing dual spouts thereon;

FIG. 9 is a vertical sectional view taken along 9—9 of FIG. 8;

FIG. 10 is a side elevational view, somewhat similar to FIG. 1, and shown partially in phantom lines, with a blow-out tube connected to the spout on the device for removing entrained wax of any foreign particles in the spout, when not in use;

FIG. 11 is a vertical sectional view, somewhat similar to FIG. 3, and showing a modified form of device with a spatula in place of a wax deposition tip;

FIG. 12 is a fragmentary top plan view showing a portion of the spatula of FIG. 11;

FIG. 13 is a vertical sectional view taken along line 13—13 of FIG. 12;

FIG. 14 is a side elevational view, somewhat similar to FIG. 1, and showing removable application tips for attachment to the spout of the wax application device;

FIG. 15 is a side elevational view, similar to FIG. 1, and showing a modified form of the device without the provision of an electric heater element; and FIG. 16 is a vertical sectional view, somewhat similar to FIG. 3, and showing an attachment for the device for removing wax from a substrate.

DETAILED DESCRIPTION

Referring now in more detail and by reference characters to the drawings which illustrate several practical embodiments of the present invention, $A_1$ designates a wax application tool comprising an outer housing, somewhat in the form of a bowl 10, and having a continuous side wall 12 and a bottom wall 14 along wih an open-ended top 16. The bowl 10 defines an interior reservoir 18 which is capable of receiving a wax substance.

The housing 10 is provided with a horizontally disposed sleeve or retaining tube 20 which is essentially in parallel relationship to the base or bottom wall 14 and located above the bottom wall 14. The tube 20 extends entirely through the reservoir 18 and exteriorly of the bowl 10 in a rearward direction, as illustrated in FIGS. 1–3 of the drawings. Moreover, the sleeve 20 terminates at the forwardly presented end of the bowl 10.

The bowl 10, as well as the other components, as hereinafter described, are generally made of a copper or form of copper combination, although any of a number of metals may be used in the construction of the tool A. One of the important criteria in the selection of the materials for construction is that it must be relatively pervious to the wax substance contained therein in order to prevent sticking of the wax to the interior of the bowl or to the other components in which the wax flow will exist. However, it is also possible to construct the tool A of other materials which are lined, for example, with a Teflon lining or the like.

As illustrated in FIG. 1, a somewhat conventional handle mechanism, designated by reference numeral H, is illustrated and includes a handle 22 internally carrying a heater rod 24, the latter having an internal nichrome heating wire 26. It can be observed that the heating rod 24 extends forwardly of the handle 22 and the user of the device engaging the handle is protected by means of a rubber shield 28 extending annularly around the forward end of the handle 22. Moreover, the heater element 24 is connected by means of an electrical conductor 30 to a conventional rheostat 32, or similar voltage control device, for regulating the temperature produced by the heater element 24. The rheostat 32 would be provided with a plug or similar connector (not shown) for connection to a suitable source of electrical current, such as 110 volt AC power or 240 volt AC power.

With reference to FIG. 4, it can be observed that the retaining sleeve 20 is sized to retentatively, but nevertheless removably, retain the extended heater element 24. In this way, it can be observed that the heater element 24 actually serves to secure the handle 22 to the tool A, as well as to provide a source of heat within the reservoir 18. Moroever, and in the same respect, it can be observed that the handle or mechanism H can be used in a number of differently shaped and sized bowls 10, in accordance with the present invention.

Extending outwardly from the housing 10 is a spout 34 which is angulated downwardly and which is provided with an aperture 36 at its lower end for the passage of a hot wax substance. In this case, it can be observed that the lower end of the spout 34 is located somewhat upwardly with respect to the plane of the bottom wall 14 forming part of the bowl 10. The spout 34 extends inwardly into the reservoir 18 through the side wall 12 of the bowl 10 and is connected through an arcuate section or so-called "neck" 38 to a capillary tube 40, often referred to as a "collecting tube." In this case, it can also be observed that the lower end of the collecting tube 40 is located above the plane of the bottom wall 14, but below the plane of the aperture 36 when the bowl 10 is located in a substantially horizontal position. Moreover, the space between the lower end of the capillary tube 40 and the bottom wall of the housing 10 serves as a sediment trap to prevent impurities such as the heavier particulate impure matter from entering the lower end of the capillary tube 40. In this way, the impurities will not enter the tube 40 and clog the spout 34 which would otherwise impede the flow of wax.

The spout 34, the arcuate section 38 and the capillary tube 40 are all internally bored providing fluid communication therebetween. Moreover, the size of the bore especially in the capillary tube 40 is sufficiently small so that the wax, when in the heated state will rise in the capillary tube much in the same manner as mercury rises in a tube by capillary action. Thus, by reference to FIG. 5, it can be observed that when the wax substance is heated, the meniscus of the wax substance in the capillary tube 40 is located above the surface of the wax substance located within the reservoir. Furthermore, the aperture 36 is located above the lower end of the tube 40 by a distance designated as "$X_1$." When the user of the device desires to apply the heated wax substance to a substrate (not shown), the user merely tips the device so that the aperture 36 in the spout 34 is tilted downwardly, as illustrated in FIG. 6.

When the aperture 36 is located in a plane below the lowest point of the bottom wall 14, or at least below the lower end of the capillary tube 40, as designated by the distance designated as "$X_2$," the wax substance in the capillary tube 40 will pass through the arcuate section 38 since the arcuate section 38 will also be tiled downwardly somewhat. As this occurs, a siphoning action results where the wax will pass from the capillary tube 40 and through the arcuate section 38 and out of the spout 34. This siphoning action will continue and continuously siphon the hot wax substance from the reservoir 18 for application to the substrate until such time as the bowl 10 is shifted to its upright position, that is the position where the bottom wall 14 is located in a relatively horizontal plane. As this occurs, and as more fully illustrated in FIG. 6, it can be observed that wax flow will cease since the aperture 36 is now located in a plane above the lower end of the capillary tube 40. Moreover, it can be observed that this siphoning action will cease immediately at the point in time when the aperture 36 is tilted to a plane above the lower end of the capillary tube 40. In this way, the user of the device has complete control over the flow of wax from the spout 34 by merely tilting the bowl 10 and which does not require any attendant valve mechanism or the like.

It can be observed that the neck 38 extends inwardly into and is connected to the spout 34 at a point in approximate vertical alignment with the axis of the retaining tube 20. Moreover, the spout 34 enters the housing 10 above the retaining tube 20. With respect to FIG. 2, it can be observed that the neck 38 is angulated slightly to one side of the retaining tube 20 and is then bent toward the plane of the retaining rod 20 somewhat. By means of this construction, it can be observed that the neck 38 and a portion of the capillary tube 40 is located in contact with and, hence, in heat conductive relationship to the retaining rod 20.

FIG. 7 represents a modified form of wax application tool $A_2$ which is substantially similar in construction to the tool $A_1$ which includes a lid 44 which is hingedly connected to the bowl 10 near the rearward end thereof by means of a conventional hinge 46. Moreover, the lid 44 and the bowl 10 could be provided with a conventional latch or locking mechanism (not shown), if desired.

FIG. 8 and 9 represent another modified form of wax application tool $A_3$, which is also similar in its construction to the tool $A_1$. In this case, the wax application tool $A_3$ includes a pair of spouts 50 and 52, each of which extend into the reservoir 18 and are connected through arcuate sections or "necks" 54 to capillary tubes 56. In this case, the arcuate necks 54 do not partially wrap around the retaining tube 20, but merely extend downwardly into the reservoir 18 in closely spaced relationship to the retaining tube 20. In this way, the capillary tubes 56 are still located in heat conductive relationship to the retaining rod 20. By reference to FIG. 9, it can also be observed that the spouts 52 and 54 are similar in construction to the spout 34 and in like manner, the capillary tubes 56 are similar to the capillary tube 40 and both have the same positional relationships with respect to the housing 10 in the tool $A_3$, as was the case in tool $A_1$.

This tool $A_3$ has also been found to be highly effective in cases where the user of the tool wishes to apply a pair of lines of the wax substance in substantially parallel relationship. Moreover, by properly manipulating the tool $A_3$, it is possible to generate a variety of other geometric relationships of the hot wax substance.

FIG. 10 illustrates the use of the wax application tool $A_1$ in conjunction with a blow-out tube 60. In this case, it can be observed that the blow-out tube 60 is arcuately shaped, somewhat in the shape of a semi-circle, and has one end which is sized to fit over the lower end of the spout 34. The blow-out tube 60 is also provided with an internal bore so that the user of the tube merely engages the opposite end, that is the end designated by numeral 62, in his lips and blows into the blow-out tube 60 and through the spout 34 and capillary tube 40. In this way, the user of the blow-out tube 60 can remove any foreign particles or any wax which might otherwise be entrained in the spout 34 after use thereof.

FIGS. 11, 12 and 13 represent a further modification of a wax application tool designated as $A_4$. The tool $A_4$ is similar to the tool $A_1$, but includes a different form of spout means. In this case, the tool $A_4$ includes a capillary tube 64 which connects to an arcuately-shaped neck 66, and which are substantially identical in construction to their respective capillary tube 40 and connecting neck 38 in the tool $A_1$. Located outwardly of the bowl 10 in the manner as illustrated in FIG. 11 is an initial stub tube 68 which merges into a spatula 70, the latter having a relatively flat top wall 71 and a relatively flat bottom wall 62. Moreover, an aperture 74 on the upper surface of the spatula 70 located near the end of the stub tube 68 communicates with an internal duct 76 in the stub tube 68 of the spatula 70 which, in turn, communicates through the neck 66 in the capillary tube 64 with the reservoir 18.

The wax application tool $A_4$ is highly effective for use where it is desired to apply a flat ribbon-like wax coating to a substrate. In this case, the wax is emitted through the aperture 74 on the upper surface 71 of the spatula and effectively rolls across the surface of the spatula 70 to the sides and to the substrate. In this way, the spatula 70 can effectively apply the wax to the substrate. Moreover, the sides of the spatula are slightly curved inwardly along the bottom portion so that the wax actually adheres to the underside of the spatula by surface tension and in this way is applied in a relatively flat band. If desired, it is also possible to locate the aperture 74 on the lower surface of the spatula so that it projects through the bottom wall 72.

FIG. 14 represents another modified form of wax dispensing mechanism $A_5$ and which is similar to the dispensing mechanism $A_1$. However, in this case, the dispensing mechanism $A_5$ includes a relatively short stub tube 78 which projects outwardly of the bowl 10 in a substantially horizontal plane. An enlarging collar 80 is secured to the outer end of the stub tube 78 and projects slightly downwardly. Moroever, a removable spout 82 is provided for attachment to the collar 80. In this case, the spout 82 has a retaining sleeve 84 and a spout tube 86. The retaining sleeve 84 is provided with a pair of opposed slots 88 so that the retaining sleeve 84 may be slipped over the collar 80 in a tight-fitting, but nevertheless removable, manner. Moroever, it should be observed that a number of spouts 104 can be provided for attachment to the collar 80. These spouts would possibly have varied diameters for optional control of wax flow.

FIG. 15 represents a device $A_6$ which is similar in many respects to the device $A_1$, except that the device $A_6$ does not include a heating means which is used in the remaining devices described heretofore. The device $A_6$ inclues a bowl 10 which is similar to the bowl 10 used in the device $A_1$ and a spout 34 which is similar to the spout 34 used in device $A_1$. While not shown, this spout 34 is connected to a connecting neck similar to the connecting neck 38 and to a capillary tube also similar to the capillary tube 40. However, this device $A_6$ includes an outwardly extending support rod 90 which provides for securement of a handle 92 which is preferably of a non-metallic material such as wood or the like. Nevertheless, the device $A_6$ which does not necessarily include the heating means, does function to carefully monitor and control a flow of liquid wax which is applied to the surface of the substrate by very carefully tipping the spout 34 in a downward direction in order to apply the wax and tipping the spout 34 upwardly in order to automatically cease the flow of the wax.

FIG. 16 represents still another modified form of device $A_7$ constructed in accordance with an embodiment of the present invention and which is similar in many respects to the device $A_1$. However, the device $A_7$, as illustrated in FIG. 16, functions as a wax withdrawal or removal device. In this case, the device $A_7$ includes an outer housing 102 which is provided with a spout 104 and a connecting neck 106, along with a capillary tube 108. In this respect, the housing 102, the spout 104, the connecting neck 106 and capillary tube 108 are the same in construction as that illustrated in device $A_1$ and described in connection therewith. Moreover, the device $A_7$ is provided with a removable plug 110 which may be in the form of a cork or other plug or the like. The plug 110 is provided with a metal tube 112 which extends through the plug 110 and into the reservoir 18. A flexible tube 114 made of a flexible plastic or rubber material is connected to and extends from the metal tube 112. The device $A_7$ is highly unique in that it is capable of removing wax which has previously been deposited on the substrate. In this case, it can be observed that the spout 104 is heated through heat conductivity with the support rod 20 and, in this case, as the tip of the spout 104 is applied to the wax substrate, the wax which has been previously deposited will be reheated. Moroever, by creating a suction within the chamber 18, the wax will tend to withdraw through the spout 104, the neck 106 and the capillary tube 108 and into the reservoir of liquid wax. The user of the device merely engages the end of the rubber tube 114 in his mouth and creates a suction thereon in order to operate this particular device. In addition, it has been found that by blowing into the tube 114, it is literally possible to force the wax out of the spout and onto the substrate in the form of an extrusion of the wax.

Thus, there has been illustrated and described a unique and novel wax application device which fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications are deemed to be covered by the invention which is limited only by the following claims.

Having thus described my invention, what I desire to claim and secure by letters patent is:

1. An article for depositing a hot wax substance on a substrate in a desired pattern and which utilizes no external source of pressure for moving the substance, said article comprising:

a. a housing having a side wall and a bottom wall forming a reservoir therein for retaining a wax substance in a relatively liquid state, b. handle means located on said housing, c. spout means extending outwardly from said housing and extending downwardly therefrom and having an outer end terminating in an aperture capable of depositing said wax substance on said substrate, d. a collecting tube communicating with said spout means and extending downwardly in essentially a vertical direction in said reservoir when said bottom wall is in an essentially horizontal plane and below the surface of a wax substance located in said reservoir and having a lower end terminating in an inlet opening somewhat in close proximity to said bottom wall, e. said collecting tube having a central duct of sufficiently small diameter to cause a type of capillary action therein to cause a capillary rise of the wax substance therein without an external source of pressure such that the level of the wax substance in said collecting tube will always be at least slightly above the level of the wax substance in said reservoir when the level of wax substance in said reservoir is essentially horizontal, and f. arcuate connecting means connecting said collecting tube and said spout means such that the level of the wax substance in the collecting tube is below said arcuate connecting means but capable of entering the connecting means and spout means on tipping of the housing and without an external source of pressure, said spout means having a relatively small interior diameter approximating that of the collecting tube, so that when said housing is tilted downwardly in the direction of the end of said spout means and the outer end of the spout means is below the lower end of said collecting tube, the wax substance will flow evenly and smoothly in a controlled manner from said collecting tube through said connecting means and spout means to said substrate by a siphoning type action and which siphoning action and the flow of wax substance through said spout means will substantially immediately close upon tilting of the housing to its initial upright position.

2. The article of claim 1 further characterized in that opening of said collecting tube is located in proximity to the bottom wall of said housing but is slightly spaced above from said bottom wall.

3. The article of claim 2 further characterized in that said housing has an open upper end, and a lid member pivotal on said housing and removably disposable over said open upper end.

4. The article of claim 1 further characterized in that a heating means extends into said reservoir and is located in heat conductive relationship to said collecting tube.

5. The article of claim 4 further characterized in that said heating means comprises a retaining member extending across said reservoir and being in contact with said collecting tube and a heat generating member retentively held in fixed relationship to said retaining member.

6. The article of claim 4 further characterized in that temperature control means is operatively connected to said heating means to regulate the heat of said wax substance.

7. The article of claim 1 further characterized in that said spout means comprises a single spout extending from said housing and having an aperture at the outer end for depositing said wax substance directly on said substrate.

8. The article of claim 1 further characterized in that said spout means comprises a plurality of spouts, each of which have an aperture at outer ends thereof for depositing said wax substance directly on said substrate.

9. The article of claim 1 further characterized in that an attachment sleeve is located on an outer end of said spout means, and a plurality of removably connectable wax substance depositing tips for provided for removable attachment to said attachment sleeve.

10. The article of claim 1 further characterized in that a spatula extends from said spout means.

11. The article of claim 1 further characterized in that a spatula extends from said spout means and is provided with an aperture for exit of said wax substance to said substrate.

12. The article of claim 11 further characterized in that said aperture is located on an upper surface of said spatula.

13. The article of claim 1 further characterized in that a blow-out tube is provided for attachment to the outer end of said spout means to blow into said reservoir any remnants in said spout means and collecting tube.

14. An article for depositing a hot wax substance on a substrate and removing a wax substance from a substrate and which utilizes no external source of pressure or vacuum for applying said wax substance or removing said wax substance from said substrate, said article comprising:

a. a housing having a reservoir therein for retaining a wax substance in a relatively liquid state, said housing having an enclosing body portion and an opening communicating with said reservoir, b. handle means located on said housing, c. spout means extending outwardly from said housing and extending downwardly therefrom and having an outer end terminating in an aperture capable of applying said wax substance to and removing said wax substance from said substrate when said wax substance is in a relatively liquid state, d. a collecting tube communicating with said spout means and extending downwardly in an essentially vertical direction in said reservoir when said bottom wall is in an essentially horizonal plane below the surface of the wax substance therein and having a lower end terminating in an opening somewhat in close proximity to said bottom wall where said wax substance is located in said collecting tube, e. said collecting tube having a central duct of sufficiently small diameter to cause a type of capillary rise of the wax substance therein without an external source of pressure such that the level of the wax substance in said collecting tube is at least slightly above the level of the wax substance in said reservoir when the level of wax substance in said reservoir is essentially horizontal, f. connecting means connecting said collecting tube and spout means such that the level of the wax substance in the collecting tube is below said arcuate connecting means but capable of entering the connecting means and spout means on tipping of the housing and without an external source of pressure so that when said housing is tilted downwardly in the direction of the end of said spout means and the outer end of the spout means is below the lower end of said collecting tube, the wax substance will flow evenly and smoothly from said collecting tube through said connecting means and spout means to said substrate by a siphoning type action and which siphoning action and the flow of wax substance through said spout means will substantially immediately close upon tilting of the housing to its initial upright position, g. a plug element operatively extendible over said opening in said enclosing body portion, h. suction tube means associated with said plug element for imposing a suction in said reservoir and at the aperture on said spout means to withdraw said wax substance from said substrate through said spout means and collecting tube into said reservoir.

15. The article of claim 14 further characterized in that heating means is located in said housing and associated with said spout means for applying heat to said spout means and to said wax substance on said substrate.

16. The article of claim 16 further characterized in that said collecting tube has a central duct of a sufficiently small interior diameter to cause a capillary type of action and that said spout means has a relatively small interior diameter approximating that of said collecting tube.

17. An article for depositing hot wax substance on a substrate in a desired pattern and which requires no external source of pressure for moving said wax substance, said article comprising:

a. a housing having a side wall and a bottom wall forming a reservoir therein for retaining a wax substance in a relatively liquid state, b. a sleeve extending into said reservoir and outwardly of said side wall of the housing, c. handle means located on said housing and being operatively located to extend axially with respect to said sleeve, d. an electrically operable heating rod extending into said sleeve and at least the portion thereof located in said reservoir for heating said sleeve and the wax substance in the reservoir, e. spout means extending outwardly from said housing and extending downwardly therefrom and terminating in an aperture capable of depositing said wax substance on said substrate, f. a collecting tube communicating with said spout means and extending downwardly in said reservoir and below the surface of a wax substance located in said reservoir, g. said collecting tube having a central duct of sufficiently small diameter to cause a type of capillary action therein to cause a capillary rise of the wax substance therein without an external source of pressure, h. arcuate connecting means connecting said collecting tube and said spout means so that when said housing is tilted downwardly in the direction of the end of said spout means, the wax substance will flow from said collecting tube through said connecting means and spout means to said substrate by a siphoning type action and which siphoning action and the flow of wax substance through said spout means will substantially immediately close upon tilting of the housing to its initial upright position, h. arcuate connecting means connecting said collecting tube and said spout means so that when said housing is tilted downwardly in the direction of the end of said spout means, the wax substance will flow from said collecting tube through said connecting means and spout means to said substrate by a siphoning type action and which siphoning action and the flow of wax substance through said spout means will substantially immediately tilting of the housing to its initial upright position, i. at least one of said collecting tube or arcuate connecting means being located in at least close proximity to said sleeve and in heat conductive relationship with respect to said sleeve so that at least said collecting tube is conductive;ly heated thereby and so that any wax substance contained in said collecting tube and said reservoir will also be heated only through heat conducted through said sleeve.

18. The article of claim 18 further characterized in that said collecting tube is vertically located in said housing when the bottom wall thereof is in an essentially horizontal plane and said tube has an open end located in proximity to the bottom wall of said housing but being spaced slightly above from said bottom wall.

19. The article of claim 19 further characterized in that said arcuate connecting means is located above the level of wax substance when said bottom wall is in a relatively horizontal plane, and that the level of the wax substance in said collecting tube is slightly above the level of the wax substance in said reservoir when the level of wax in said reservoir is in a relatively horizontal plane.

20. The article of claim 17 further characterized in that said sleeve is located in heat conducive contact with at least one of said collecting tube or arcuate connecting means.

21. The article of claim 17 further characterized in that said sleeve extends entirely across said reservoir.

22. The article of claim 17 further characterized in that temperature control means is operatively connected to said heating rod to regulate the heat of said wax substance.

23. The article of claim 17 further characterized in that the arcuate connecting means connects said collecting tube and said spout means in such manner such that the level of the wax substance in the collecting tube is below said arcuate connecting means but capable of entering the connecting means and spout means on tipping of the housing and without an external source of pressure, and said spout means having said relatively small interior diameter approximating that of the collecting tube, so that when said housing is tilted downwardly in the direction of the end of said spout means and the outer end of the spout means is below the lower end of said collecting tube, the wax substance will flow evenly and smoothly in a controlled manner from said collecting tube and connecting means and spout means.

24. An article for depositing a hot wax substance on a substrate in a desired pattern and which requires no external source of pressure for moving said wax substance, said article comprising:

a. a housing having a side wall and a bottom wall forming a reservoir therein for retaining a wax substance in a relatively liquid state, b. a sleeve extending into said reservoir and outwardly of said side wall of the housing, c. handle means located on said housing and being operatively located to extend axially with respect to said sleeve, d. an electrically operable heating rod extending into said sleeve and at least the portion thereof located in said reservoir for heating said sleeve and the wax substance in the reservoir, e. spout means extending outwardly from said housing and extending downwardly therefrom and having an outer end terminating in an aperture capable of depositing said wax substance on said substrate, f. a collecting tube communicating with said spout means and extending downwardly in essentially a vertical direction in said reservoir when said bottom wall is in an essentially horizontal plane and below the surface of a wax substance located in said reservoir and having a lower end terminating in an inlet opening somewhat in close proximity to said bottom wall but slightly spaced above from said bottom wall, g. said collecting tube having a central duct of sufficiently small diameter to cause a type of capillary action therein to cause a capillary rise of the wax substance therein without an external source of pressure such that the level of the wax substance in said collecting tube will always be at least slightly above the level of the wax substance in said reservoir when the level of wax substance in said reservoir is essentially horizontal, h. a arcuate connecting means connecting said collecting tube and said spout means being located above the level of the wax substance in the reservoir and above the level of the wax substance in the collecting tube, said arcuate connecting means being located so that the wax substance in said collecting tube is capable of flowing into said connecting means and spout means on tipping of the housing and without an external source of pressure, said spout means having a relatively small interior diameter approximating that of the collecting tube, so that when said housing is tilted downwardly in the direction of the end of said spout means and the outer end of the spout means is below the lower end of said collecting tube, the wax substance will flow evenly and smoothly in a controlled manner from said collecting tube through said connecting means and spout means to said substrate by a siphoning type action and which siphoning action and the flow of wax substance through said spout means will substantially immediately close upon tilting of the housing to its initial upright position, i. at least one of said collecting tube or arcuate connecting means being located in at least close proximity to said sleeve in heat conductive relationship with respect to said sleeve so that at least said collecting tube is conductively heated thereby and so that any wax substance contained in said collecting tube and said reservoir will also be heated only through heat conducted through said sleeve.

25. The article of claim 24 further characterized in that a heating means extends into said reservoir and is located in heat conductive relationship to said collecting tube.

26. The article of claim 25 further characterized in that said heating means comprises a retaining member extending across said reservoir and being in contact with said collecting tube and a heat generating member retentively held in fixed relationship to said retaining member.

27. The article of claim 26 further characterized in that temperature control means is operatively connected to said heating means to regulate the heat of said wax substance.

* * * * *